United States Patent [19]

Berenfield et al.

[11] Patent Number: 4,632,272

[45] Date of Patent: Dec. 30, 1986

[54] LID STRUCTURE HAVING FASTENING MEANS

[75] Inventors: Leonard H. Berenfield, Wyoming; Haron W. Wise, Montgomery; Paul G. Bordner, Pickerington, all of Ohio

[73] Assignee: Berenfield/Midwest Corporation, Mason, Ohio

[21] Appl. No.: 714,904

[22] Filed: Mar. 22, 1985

[51] Int. Cl.[4] ..... B65D 45/16

[52] U.S. Cl. ..... 220/324; 220/306; 206/508

[58] Field of Search ..... 220/306, 359, 324; 206/508; 150/55; 215/DIG. 1, 316, 317

[56] References Cited

U.S. PATENT DOCUMENTS

| | | | |
|---|---|---|---|
| 2,205,685 | 6/1940 | Conner . | |
| 2,978,142 | 4/1961 | Novick . | |
| 3,288,342 | 11/1966 | Tinker . | |
| 3,321,104 | 5/1967 | Edwards . | |
| 3,460,711 | 8/1969 | Al-roy . | |
| 3,743,133 | 7/1973 | Rathbun . | |
| 3,883,036 | 5/1975 | Mahaffy et al. . | |
| 4,051,951 | 10/1977 | Smith . | |
| 4,106,653 | 8/1978 | Martinelli . | |
| 4,141,463 | 2/1979 | Smith | 220/359 |
| 4,194,645 | 3/1980 | Zabner . | |
| 4,311,238 | 1/1982 | Smith . | |
| 4,380,305 | 4/1983 | Von Holdt | 220/306 |

*Primary Examiner*—George T. Hall

*Attorney, Agent, or Firm*—Wood, Herron & Evans

[57] ABSTRACT

A flexible, plastic lid for sealing containers such as drums and pails having an open top formed with a contoured lip includes a center portion and an annular edge portion extending radially outwardly from the center portion. The annular edge portion comprises an inner curl, an outer curl and an intermediate curl disposed therebetween. The outer curl is formed with a convex inner surface having spaced projections which is adapted to flex and stretch over the contoured lip of the drum so that the inner surface, including the spaced projections, engage the lip to form an effective seal therebetween. A number of locking clips are spaced at regular intervals about the lid and are adapted to snap-fit over the lid and against the lip of the container to enhance the seal therebetween.

7 Claims, 5 Drawing Figures

LID STRUCTURE HAVING FASTENING MEANS

BACKGROUND OF THE INVENTION

This invention relates to lid structures, and, more particularly, to a flexible lid for sealing metal, fiber or plastic drums.

Drums, pails or other containers formed of steel, aluminum, plastic or wound liner board are commonly used to transport a variety of materials including certain pharmaceutical products which must be tightly sealed to avoid damage or contamination. Many commercially available drums are formed with an open top having a curved or contoured lip. One lid structure which is commonly used to seal the top of such drums includes a circular sheet of metal or plastic having a downwardly extending flange. The lid is placed over the open top of the drum so that its flange extends over the lip and around the outer wall of the drum. A metal locking ring is then fitted about the flange and tightened to seal the flange to the lip and to the drum wall.

A problem with this type of closure is that the circumference of open tops of drums, and the diameter of their contoured lips, may have some degree of dimensional variance due to production tolerances or as a result of distortion after repeated use. The combination of a rigid top and locking ring may not produce a tight seal of drums whose circumference or lip diameter vary in dimension from a predetermined range to any significant degree. In addition, the locking ring is relatively expensive and adds substantially to the total cost of the drum.

SUMMARY OF THE INVENTION

In a broad aspect of this invention, a plastic lid structure is provided which is capable of sealing the open top of drums, pails and other containers having a relatively wide range of dimensional variation, and which cooperates with locking clips to create a tight seal of the drum while permitting stacking of several drums one on top of the other.

In a more specific aspect of this invention, the lid structure herein is adapted to seal a container such as a drum having an outer wall, a closed bottom formed with a rim and an open top formed with a contoured lip. The lid structure is formed of high density polyethylene or polypropylene and includes a generally S-shaped annular edge connected to a circular center portion. The S-shaped edge comprises an inner curl connected to the center portion, an outer curl and an intermediate curl disposed between the inner and outer curls. The outer curl is formed with a curved inner surface which is sufficiently flexible to stretch over and snap-fit to the contoured lip of the drum so that at least a portion of the inside surface of the outer curl engages the contoured lip forming a tight seal therebetween. In a presently preferred form, the inner surface of the outer curl also includes at least one annularly projecting ridge which engages the contoured lip of the drum to aid in creating an effective seal therebetween.

In another aspect of this invention, stacking of one drum atop another is permitted without damaging the plastic lid of the drum beneath. The intermediate curl of the lid is formed with a concave-shaped outer surface disposed between and spaced vertically downwardly from the outer surfaces of the inner and outer curls. In stacking another drum atop a drum sealed by the lid, an annular rim formed at the base of the upper drum is received within the intermediate curl of the lid. The intermediate curl radially positions the upper drum so that its outer wall generally aligns with the outer wall of the drum sealed by the lid. In this manner, most of the weight of the upper drum placed atop the sealed drum is carried by the outer wall of the sealed drum and not the plastic lid. In addition, the inner curl of the lid is provided with at least six, circumferentially spaced support tabs or gussets which strengthen the lid. These features prevent damage to the lid and provide stability in stacking several drums atop one another.

In another broad aspect of this invention, a plurality of clips are mounted at intervals about the lid which function to aid in securing the lid to the lip of the drum. In one presently preferred embodiment, each clip is generally C-shaped including a convex top portion connected to a straight bottom portion having a tail section at one end. The clip is adapted to snap-fit over the outer curl of the lid which wraps around the contoured lip of the drum so that the tail section of its straight section engages the wall of the drum.

In an alternative embodiment, the seal between the lid and drum lip is enhanced by an S-shaped clip preferably formed of spring steel. The S-shaped clip includes a concave bottom portion, a top portion and an elongated intermediate portion therebetween. The top portion of the S-shaped clip includes a convex section connected to a vertical leg, which, in turn, is connected to a horizontal leg. The S-shaped clip is adapted to snap-fit over the lid and drum lip so that its concave bottom portion seats within the concave intermediate curl of the lid, and the convex section of its top portion wraps about the convex outer curl of the lid. In this position, the right angle legs of the top portion are oriented such that the vertical leg engages the outer curl of the lid and the horizontal leg extends beneath the outer curl and engages the contoured lip of the drum. Preferably, the S-shaped clip is shaped so that it must be deformed in order to snap-fit along the lid and beneath the lip of the drum which provides a sealing, compression force therebetween.

In another embodiment, the clips are generally C-shaped and include a curved member connected to a T-shaped member having a stem and a head. The stem is formed with a semi-circular cut-out and a V-shaped notch about 180° apart adjacent the head portion, which together form a stress point between the head and stem. The clip is adapted to snap-fit over that part of the outer curl of the lid which wraps around the contoured lip of the drum, and to the lip itself. The clip is oriented so that its curved member engages the outer curl of the lid, and the head of its T-shaped member is wedged between the contoured lip and the outer wall of the drum.

When snapped in place, the clip urges the lid against the lip of the drum to further aid in maintaining a tight seal therebetween. In order to remove the lid from the drum, the clips must first be removed from the lid. This may be done by forcing a screw driver or other flat edged tool between the curved member of the clip and outer curl of the lid. As the curved member of the clip is forced away from the lid, the head of the T-shaped member is forced against the outer wall of the drum. The curved member and stem begin to pivot about the fixed head causing the stem to fracture from the head at the stress point formed therebetween. Breakage of the clips evidences tampering with the seal between the lid and drum.

The lid is preferably formed of high density polyethylene which is sufficiently flexible so that its outer curl may be forced and stretched like a rubber band over the contoured surface of the lip of the drum to create a seal therebetween. The flexibility of the lid allows for at least some variation in the dimension of the circumference of the lid of the drum, or the diameter of the lip, while still permitting an effective seal to be formed therebetween. Although the clips aid in securing the lid to the drum, as do the locking rings of prior art container lids, the clips can be manufactured at much less cost than locking rings.

DESCRIPTION OF THE DRAWINGS

The structure, operation and advantages of a presently preferred embodiment of this invention will become further apparent upon consideration of the following description taken in conjunction with the accompanying drawings wherein.

DETAILED DESCRIPTION OF THE INVENTION

Figure 2:
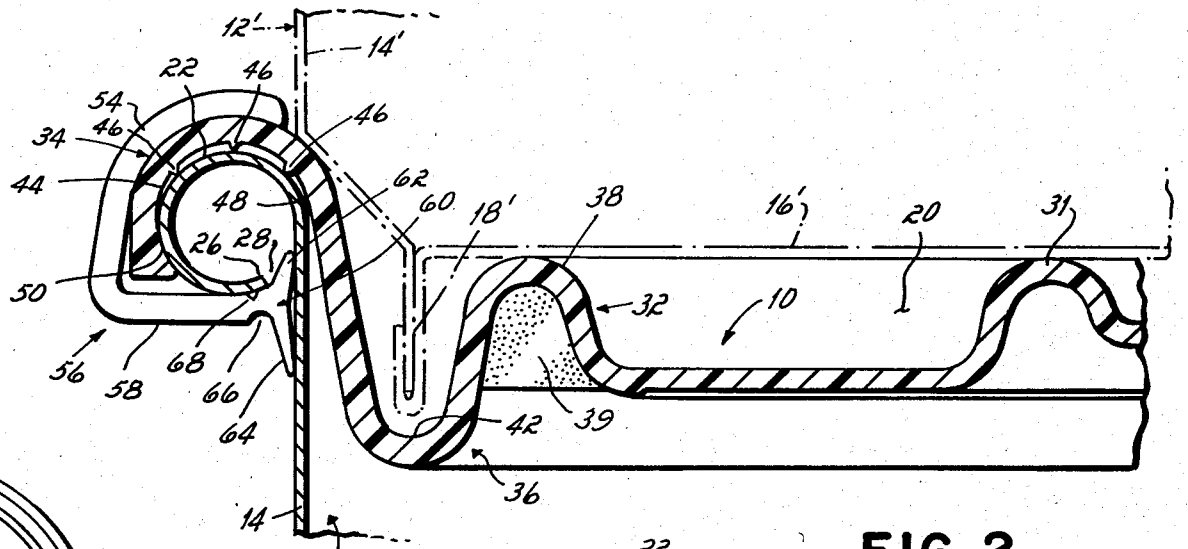
FIG. 2 is a cross-sectional view taken generally along line 2—2 of FIG. 1 which illustrates one embodiment of the lid and locking clip according to this invention, and a drum nested atop the lid as shown in phantom lines.

Referring now to the drawings, the lid 10 of this invention is adapted to seal a container such as a drum 12 having an outer wall 14 and an open top 20 formed with a contoured lip 22. The drum 12 is metal, fiber, or plastic, which may be used to transport a variety of materials including those requiring a tight seal to avoid contamination. As shown in FIG. 2, the contoured lip 22 is convex in shape and curves outwardly and then back toward the outer wall 14 of the drum 12 forming a terminal end 26 which is disposed a space 28 from the outer wall 14 of drum 12.

The lid 10 includes a circular center portion 30 having a ridge 31, which is connected to a generally S-shaped annular edge portion comprising an inner curl 32, an outer curl 34 and an intermediate curl 36 therebetween. The inner curl 32 extends about the center section 30 and is formed with a generally convex upper surface 38. Preferably, the annular, inner curl 32 is radially strengthened by the inclusion of six gussets or tabs 39 which are positioned within the inner curl 32 at approximately 60° intervals about its circumference. The intermediate curl 36 extends radially outwardly from the inner curl and includes a generally concave upper surface 42 which is spaced vertically below the upper surface 38 of the inner curl 32, for purposes to become apparent below.

The outer curl 34 is connected to the intermediate curl 36 and is adapted to sealingly engage the contoured lip 22 of the drum 12. The outer curl 34 includes a generally convex inner surface 44 having spaced inner and outer ends 48, 50, which is shaped to receive the contoured lip 22 of the drum 12. At least three generally triangular-shaped annular ridges or projections 46 are disposed along the inner surface 44 of outer curl 34 between its outer end 48 and inner end 50.

The lid 10 is formed of a polyolefin, preferably high density polyethylene or polypropylene, which provides flexibility to aid in the engagement of lid 10 with the drum 12. In a presently preferred embodiment, the space between the inner and outer ends 48, 50 of the outer curl 34 is slightly less than the diameter of the contoured lip 22 of drum 12. To secure the lid 10 to the drum 12, the outer curl 34 must therefore be forced over the lip 22 so that the space between its inner and outer ends 48, 50 is expanded. The flexibility of the outer curl 34 enables it to be stretched over and snap-fitted into a seated position about the lip 22, in a manner analogous to stretching a rubber band over the lip 22. A tight seal is created between the lid 10 and drum 12 by the engagement of the projections 46, and the outer end 50 of the lid 10, with the lip 22 of the drum 12 as shown in FIG. 2. Even if there is some dimensional variation in the diameter of the lip 22, or the circumference of the open top 20, the flexibility of lid 10 allows it to be stretched over and into sealing engagement with the lip 22.

Figure 1:
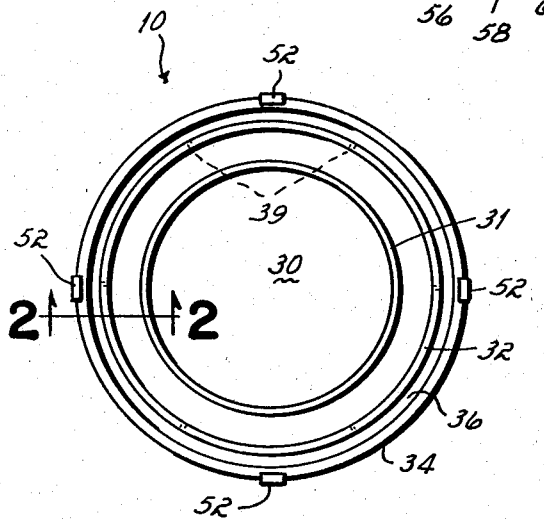
FIG. 1 is a plan view of the lid structure of this invention.

The seal between the lip 22 and lid 10 is further enhanced by a number of clips which are spaced at equal intervals about the circumference of the lid 10. In the embodiment of this invention shown in FIGS. 1 and 2, four clips 52 are spaced about 90° apart along the lid 10 circumference. Each clip 52 is generally C-shaped, including a curved member 54 connected to a T-shaped member 56. The T-shaped member 56 is formed with a stem 58 connected to a head 60 having a first arm 62 and a longer, second arm 64. A semi-circular cut-out 66 is formed in the stem 58 at its connection to the longer, second arm 64 and a V-shaped notch 68 is formed in the stem 58 about 180° from the cut-out 60 at the connection between the stem 58 and first arm 62. The cut-out 66 and notch 68 together form a weakened area or stress point at the connection between the stem 58 and head 60 of T-shaped member 56.

The clips 52 are secured to the lid 10 and drum 12 in the following orientation. The curved member 54 of the clips 52 extends about the outer curl 34 of lid 10 which engages the contoured lip 22 of drum 12, the first arm 62 of head 60 extends within the space 28 between the lid 10 and outer wall 14 of drum 12 and engages the terminal end 26 of the lip 22, and the second arm 64 of head 60 contacts the outer wall 14 of drum 12. The head 60 of T-shaped member 56 is thus wedged between the terminal end 26 of the drum lip 22 and the outer wall 14 of the drum 12, which mounts the clip 52, and in turn the lid 10, securely in place atop the lip 22.

The clips 52 perform two functions. First, they help secure the outer curl 34 of lid 10 in sealing engagement with the contoured lip 22 of drum 12. Although it is contemplated that in most instances the lid 10 will be self-sealing, the clips 52 provide added assurance that an effective, tight seal will be maintained therebetween.

Figure 3:
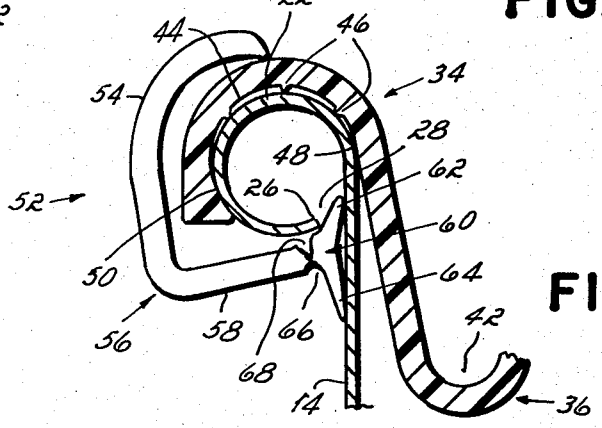
FIG. 3 is a view similar to FIG. 2 except with the locking clips being removed to break the seal between the lid and drum.

In addition, clips 52 provide evidence of tampering with the seal between the lid 10 and drum 12. In order to remove the lid 10, the clips 52 must be removed first as shown in FIG. 3. To separate the clips 52 from lid 10, a screw driver or other flat edged tool is forced between the curved member 54 of clips 52 and the outer curl 34 of lid 10. As the curved member 54 is pried away from the outer curl 34, the second arm 64 of the head 60 of the clips 52 is forced against the outer wall 14 of the drum 12. Since the head 60 is wedged in a fixed position between the terminal end 26 of the lip 22 and the outer wall 14, the curved member 54 and stem 58 pivot about the head 60. Before the clips 52 can be completely pried away from the outer curl 34, sufficient force is applied to break the stem 58 from the head 60 at the stress point formed therebetween. If the clips 52 are broken, it is evident that there may have been tampering with the seal between the lid 10 and drum 12. Preferably, the locking clips 52 are formed of a rigid, relatively brittle material such as polyvinylchloride so as to permit them to be snapped into place about the lid 10 but readily broken upon removal with a tool such as a screw driver.

Figure 4:
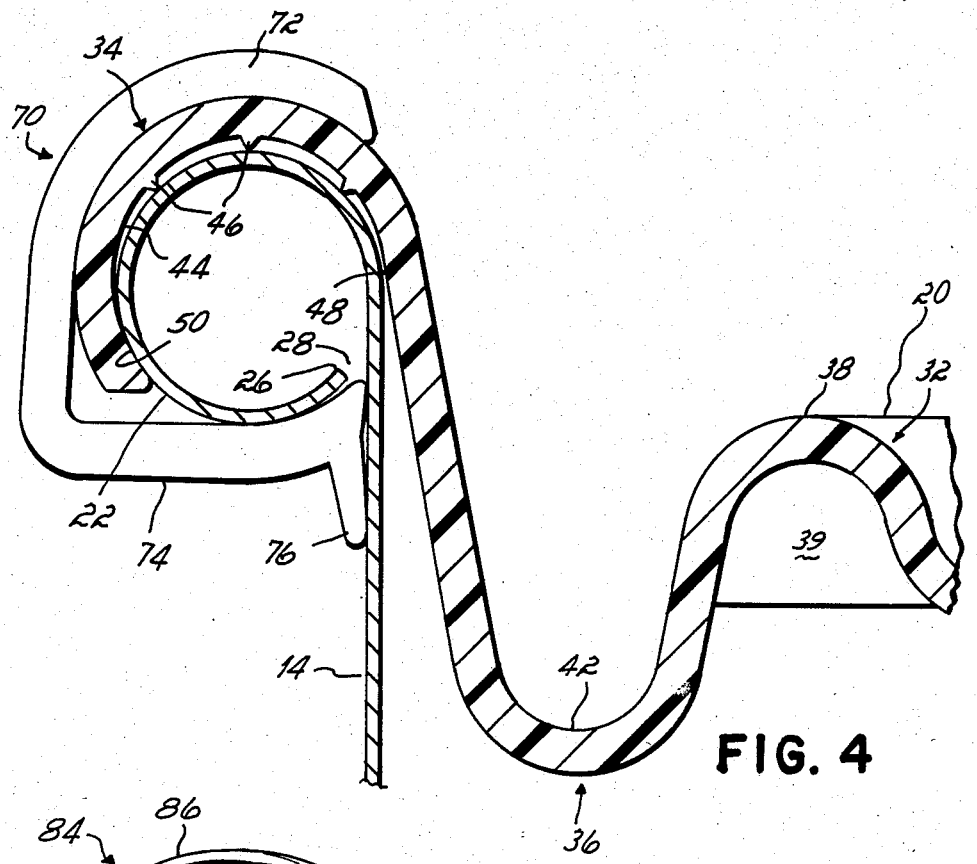
FIG. 4 is a view similar to the left portion of FIG. 1 of an alternative embodiment of the locking clips of this invention.

Referring now to FIG. 4, an alternative embodiment of a locking clip 70 according to this invention is illustrated which enhances the seal between the lid 10 and drum 12. Locking clip 70 is generally C-shaped and includes a convex top portion 72 connected to a straight or horizontal bottom section 74 having an angled tail portion 76 at one end. The locking clip 70 is secured to the lid 10 and drum 12 in the following orientation. The convex top portion 72 of clip 70 extends about the outer curl 34 of lid 10, its straight bottom section 74 extends beneath the drum lip 22 and the tail portion 76 of bottom section 74 engages the outer wall 14 of drum 12 so that the lid 10 is secured tightly in place between the clip 70 and drum 12. Preferably, the locking clip 70 of this embodiment is adapted to readily snap into place about the lid 10 and can be removed with a tool such as a screwdriver without breakage. This allows the locking clip 70 to be reused a number of times.

Figure 5:
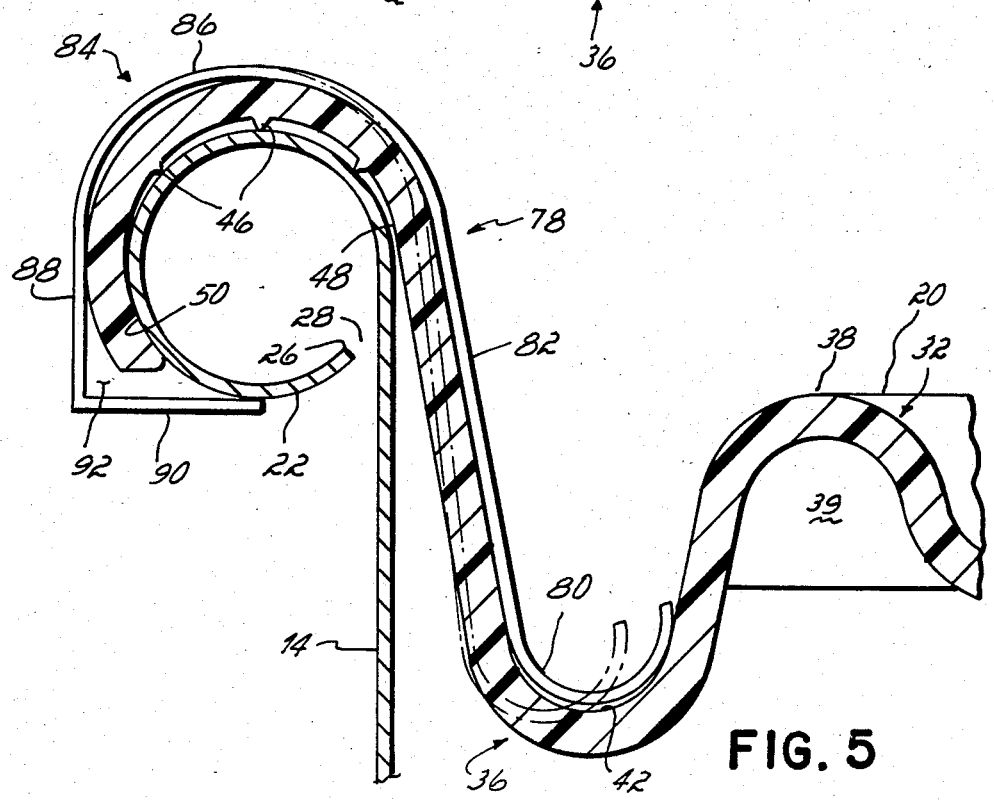
FIG. 5 is a view similar to FIG. 4 of still another embodiment of the locking clips herein.

Another embodiment of a locking clip 78 according to this invention is illustrated in FIG. 5. Locking clip 78 is generally S-shaped so as to conform to the annular edge portion of the lid 10. Locking clip 78 includes a concave bottom portion 80 connected by an elongated section 82 to a top portion 84. The top portion 84 includes a convex section 86 connected to a vertical leg 88, which, in turn, is connected to a horizontal leg 90. To secure locking clip 78 to the lid 10 and drum 12, the concave bottom portion 80 of clip 78 is placed within the intermediate curl 36 of lid 10, the convex section 86 of the top portion 84 wraps about the outer curl 34 of lid 10 and the horizontal leg 90 extends beneath and in engagement with the contoured lip 22 of drum 12. Preferably, the locking clip 78 is formed of a resilient material such as spring steel which is preloaded so that it must be deformed from its shape shown in phantom lines in FIG. 5, to the shape shown in solid lines wherein the clip 78 is positioned in engagement with the lid 10 and drum 12. By shaping clip 78 so that it deforms or bends as it is snapped into place along lid 10 and drum 12, the clip 78 applies a compression force to the lid 10 which urges it into tight engagement with drum 12 enhancing the seal therebetween.

As shown in FIG. 5, a space 92 is formed between the outer curl 34 of the lid 10 and the intersection of vertical and horizontal legs 88, 90. This space 92 is provided to permit the insertion of a tool such as a screwdriver between the clip 78 and lid 10 so that the clip 78 may be pried away from the lid 10 to remove it from the drum 12. As with the locking clip 70 of FIG. 4, the locking clip 78 of this embodiment is reusable and relatively inexpensive to manufacture.

With the lid 10 sealed to the drum 12, a second drum 12′ having a bottom 16′ formed with an annular rim 18′ may be nested atop drum 12. An advantage provided by the lid 10 of this invention is that the intermediate curl 36 is adapted to receive the bottom annular rim 18′ of the second drum 12′ so that its outer wall 14′ is positioned in alignment with the outer wall 14 of the drum 12 beneath. With the outer walls 14, 14′ of the nesting drums 12, 12′ in alignment, most of the weight of the upper drum 12′ is carried by the outer wall 14 of the drum 12 beneath. The presence of the spaced tabs 39 within inner curl provide the lid 10 with additional strength and help resist deformation of the inner curl 32 by the pressure applied by the bottom 16′ of the second drum 12′. In addition, the S-shaped spring clip 78 shown in FIG. 5 helps center the bottom annular rim 18′ of second drum 12′ to further protect the inner curl 32 and intermediate curl 36, and prevent wedging of the second drum 12′ atop the lower drum 12 so that they may be easily unstacked.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A flexible, plastic lid for sealing a container having an open top formed with a lip, comprising:

a center portion;

an annular, inner curl connected to said center portion;

an annular, intermediate curl extending radially outwardly from said inner curl;

an annular, outer curl extending radially outwardly from said intermediate curl, said outer curl having a curved inner surface formed with at least one annularly projecting ridge, said outer curl being adapted to flex and stretch over said lip of said container so that said inner surface including said projecting ridge engages said lip forming a seal therebetween, said container includes a closed bottom formed with an annular rim, said inner curl being formed with a convex outer surface, said outer curl being formed with a convex outer surface and said intermediate curl being formed with a convex outer surface spaced vertically below said outer surfaces of said inner and outer curls, said inner curl surface spaced below said outer curl surface, said lid permitting stacking of a second container atop said container sealed by said lid wherein said bottom rim of said second container is adapted to be received within said intermediate curl, said intermediate curl positioning said second container so that said outer wall of said second container substantially aligns with said outer wall of said sealed container beneath, the weight of said second container thereby being supported by said outer wall of said sealed container beneath to protect said lid from damage.

2. The flexible, plastic lid of claim 1 in which said inner surface has three triangular-shaped projecting ridges extending radially inwardly from said curved inner surface of said outer curl.

3. The flexible, plastic lid of claim 1 in which said outer curl includes an outer end portion, said outer end portion being adapted to engage said contoured lip of said container to create a seal therebetween.

4. The flexible, plastic lid of claim 1 in which said outer curl is concave in shape and includes an inner end portion spaced from an outer end portion, said space between said inner and outer end portions being less than the transverse dimension of said contoured lip so that said inner and outer end portions are flexed and stretched apart in securing said outer curl to said contoured lip.

5. The flexible, plastic lid of claim 1 in which said annular, inner curl is formed with a plurality of tabs spaced equidistant about the circumference thereof.

6. A flexible, tamper evident lid for sealing a container having an outer wall, and an open top having a lip formed with a terminal end spaced from said outer wall, said lid comprising:

a center portion;

an annular, inner curl connected to said center portion;

an annular intermediate curl extending radially outwardly from said inner curl;

an annular, outer curl extending radially outwardly from said intermediate curl, said outer curl have a curved inner surface formed with a plurality of spaced annularly projecting ridges, said outer curl being adapted to flex and stretch over said lip of said container so that said inner surface including said spaced ridges engages said lip forming an airtight seal therebetween;

at least one clip for indicating tampering with said seal between said lid and container, said clip including a curved element connected to a T-shaped element, said T-shaped element having a head and stem formed with a stress point therebetween;

said clip being adapted to snap-fit to said container and to said lid so that said curved element extends about said outer curl of said lid, and said head of said T-shaped element extends between said terminal end of said lip and said outer wall of said container;

said clip being removable in order to permit removal of said lid by forcing said curved element from said outer curl of said lid, said head of said T-shaped element remaining stationary with the movement of said curved element so that said curved element pivots about said head at said stress point between said head and stem of said T-shaped element, said pivoting motion forcing said stem to break from said head at said stress point thereby providing evidence of tampering with said seal between said container and lid.

7. The flexible, tamper evident lid of claim 6 in which a number of clips are connected to said lid and to said drum at equidistant intervals about the circumference thereof.

* * * * *